US005338242A

United States Patent [19]

Cheng

[11] Patent Number: 5,338,242

[45] Date of Patent: Aug. 16, 1994

[54] DEVICE FOR SCATTERING A MULTITUDE OF OBJECTS AND METHOD OF MAKING SAME

[76] Inventor: Peter S. C. Cheng, 99 Glencairn Street, Toronto, Ontario, Canada, M4R 1M7

[21] Appl. No.: 138,747

[22] Filed: Oct. 19, 1993

[51] Int. Cl.[5] ..... A63H 3/06; A63H 29/00; A63H 33/30

[52] U.S. Cl. ..... 446/220; 446/183; 446/429; 446/475

[58] Field of Search ..... 446/220, 221, 222, 223, 446/224, 225, 226, 183, 184, 185, 187, 198, 429, 425, 486, 487

[56] References Cited

U.S. PATENT DOCUMENTS

| | | | |
|---|---|---|---|
| 825,843 | 7/1906 | Kliemandt | 446/475 X |
| 1,567,973 | 12/1925 | Mendelson | 446/198 |
| 3,577,676 | 5/1971 | Powell | 446/183 |
| 3,664,401 | 5/1972 | Trovati | 446/220 X |
| 3,665,640 | 5/1972 | Kirk | 446/187 |
| 3,831,315 | 8/1974 | Gilbert | 446/187 |
| 4,488,374 | 12/1984 | Elson | 446/220 |
| 4,586,456 | 5/1986 | Forward | 446/220 X |
| 5,205,773 | 4/1993 | Koepcke et al. | 446/183 |
| 5,240,452 | 8/1993 | Wen | 446/475 |
| 5,254,026 | 10/1993 | Kaiser | 446/220 |

FOREIGN PATENT DOCUMENTS

| | | | |
|---|---|---|---|
| 511533 | 6/1955 | Italy | 446/475 |

*Primary Examiner*—Robert A. Hafer
*Assistant Examiner*—D. Neal Muir
*Attorney, Agent, or Firm*—Kirschstein, Ottinger, Israel & Schiffmiller

[57] ABSTRACT

A device for scattering confetti includes an inverted pocket positioned within the interior of an inflated envelope. Confetti is contained within the pocket, and a break-away closure maintains the confetti within the pocket. Upon compressing the envelope, the pocket is reversed in position, the closure ruptured, and the confetti is suddenly expelled in an explosive manner with a concomitant popping sound.

11 Claims, 2 Drawing Sheets

FIG. 4
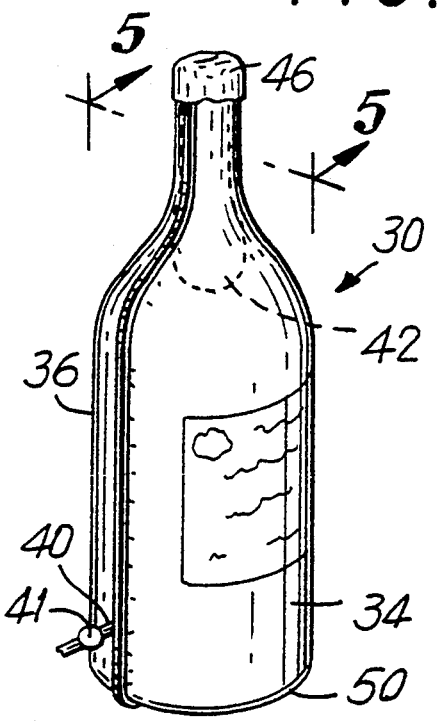
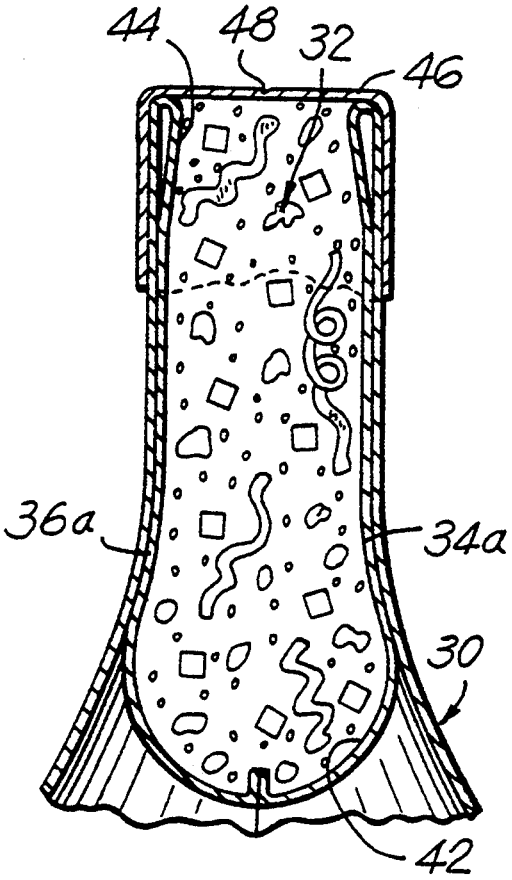
FIG. 5
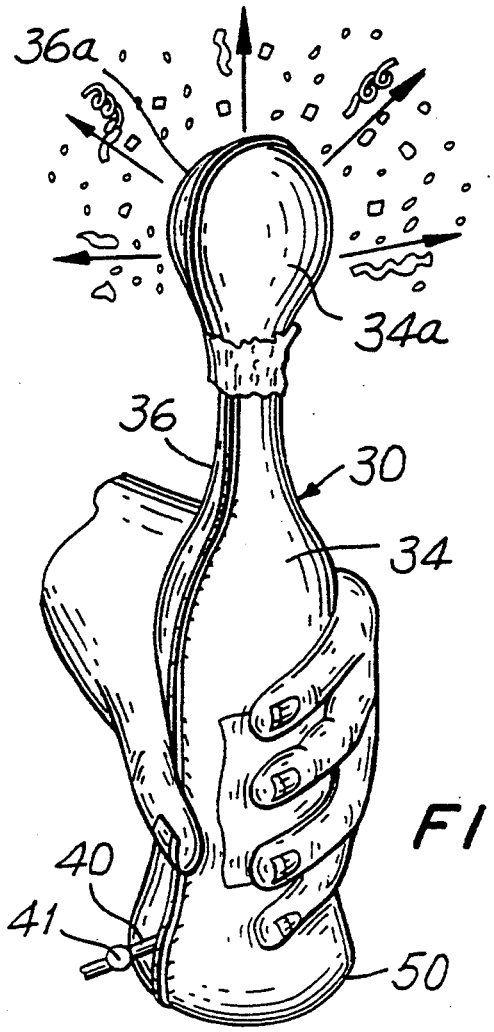
FIG. 6

DEVICE FOR SCATTERING A MULTITUDE OF OBJECTS AND METHOD OF MAKING SAME

BACKGROUND OF THE INVENTION

1. Field of the Invention

This invention generally relates to a device used on social and amusement occasions for scattering a multitude of objects and, more particularly, to a device for scattering confetti with an accompanying popping sound, as well as to a method of making the device.

2. Description of the Related Art

Upon social occasions, such as weddings or birthdays, or for purely amusement purposes, such as at carnivals, it is known to scatter confetti into the air, over floors and tables, and over people, particularly the participants of the occasion being celebrated. Representative patents in this art include: U.S. Pat. No. 825,843 discloses a confetti cannon in which confetti and an explosive are mounted within a tube. Upon pulling a detonation string, the confetti is forcefully ejected. U.S. Pat. No. 1,560,326 discloses a confetti gun including a bag formed of two sheets of material sealed about their peripheries. Confetti is placed within the bag. A discharge tube or neck extends to the bag. By forcefully squeezing and expanding the bag, the confetti is ejected. U.S. Pat. No. 4,932,915 discloses a balloon envelope into which confetti and other items are contained. After inflation, the balloon envelope is punctured, thereby causing the contents thereof to be ejected.

SUMMARY OF THE INVENTION

Objects of the Invention

It is a general object of this invention to provide a novel device for reliably scattering multiple objects, e.g., confetti, with an accompanying popping sound.

Another object of this invention is to provide a reliable, durable, yet inexpensive, device for forcefully ejecting confetti.

Another object of the invention is to provide a novel method of making such an object-scattering device.

FEATURES OF THE INVENTION

In keeping with these objects and others which will become apparent hereinafter, one feature of this invention resides, briefly stated, in a device for scattering objects, e.g., confetti, comprising an inflated, flexible envelope having walls bounding an interior, and a gas inlet for admitting a pressurized gas, e.g., air, into the interior. The walls have inverted portions extending into the interior and bound a pocket having an open end.

A multitude of objects constituting the confetti is contained in the pocket. Break-away means are provided and extend across the open end. The break-away means is operative for frangibly closing the pocket, and for rupturing upon compression of the envelope with a predetermined force sufficient to cause the gas to reverse the inverted portions, tear the break-away means, and expel the objects in an explosive manner with an accompanying popping sound.

In accordance with a preferred embodiment of this invention, the envelope includes a pair of sheets sealed together about their peripheries. The sheets may be constituted of a synthetic plastic material, paper, or a laminate. Preferably, the plastic sheets are heat-sealed together along their peripheries.

The gas inlet may include a one-way check valve extending through the envelope. The confetti may include bits of colored paper, ribbon, rice, balls, toys, mini-figurines, candy, and, in short, virtually any toy or thing can be contained in the pocket.

In accordance with the preferred embodiment, the break-away means is an adhesive closure, preferably having score lines. Alternatively, the break-away means may be a low tensile strength paper adhered over the open end of the pocket.

Another aspect of this invention relates to a method of making the aforementioned device. The method includes the following steps: Initially, an inverted pocket having an open end is formed from an inflatable, flexible envelope. Thereupon, the pocket is filled with the multitude of objects. Next, the pocket is frangibly closed by placing a break-away closure across the open end of the pocket. The envelope is inflated with a pressurized gas, and the envelope is sealed with the pocket extending into the interior of the envelope. The inflating step may, in accordance with one preferred embodiment of this invention, be performed after the closing step has been performed. Alternatively, the inflating step may be performed prior to the forming step.

In the preferred embodiment, the envelope walls have a bottle-shaped configuration. Thus, in order to celebrate a social occasion such as New Year's Eve, one merely squeezes the inflated device in one's hand with a predetermined force sufficient to cause the gas therein to push against and reverse the inverted portions. This force tears the break-away closure and expels the confetti in an explosive manner with an accompanying popping sound, which also contributes to the festivities.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a perspective view of a device in accordance with another embodiment of this invention;

FIG. 5 is an enlarged, broken-away, sectional view taken on line 5—5 of FIG. 4; and FIG. 6 is a perspective view of the embodiment of FIG. 4 during use.

DETAILED DESCRIPTION OF THE PREFERRED EMBODIMENTS

Figure 1:
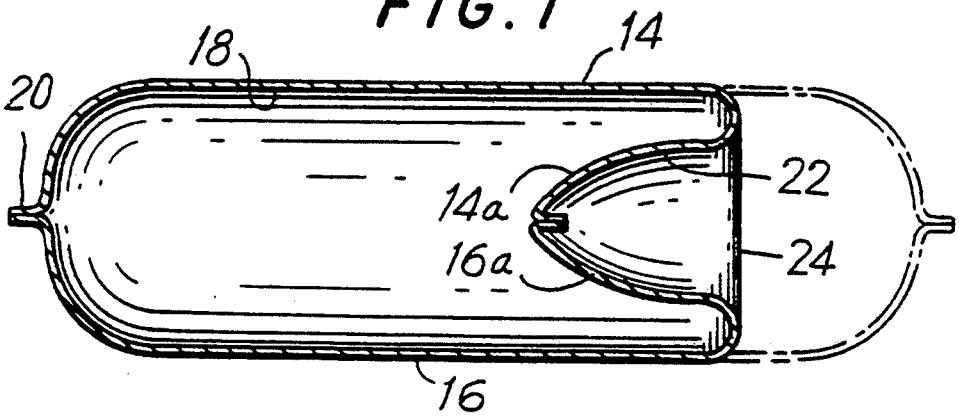
FIG. 1 is a sectional view taken along a longitudinal axis of a device in accordance with one embodiment of this invention during its manufacture.
Figure 2:
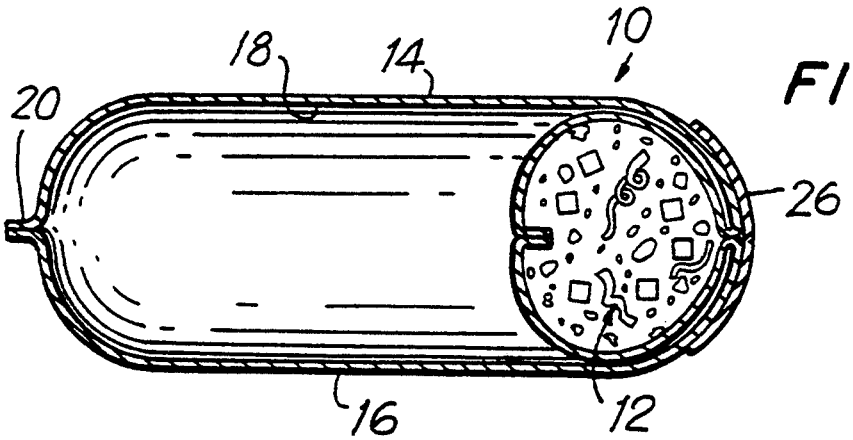
FIG. 2 is a view analogous to FIG. 1 but showing the confetti therein, and the device ready for use.
Figure 3:
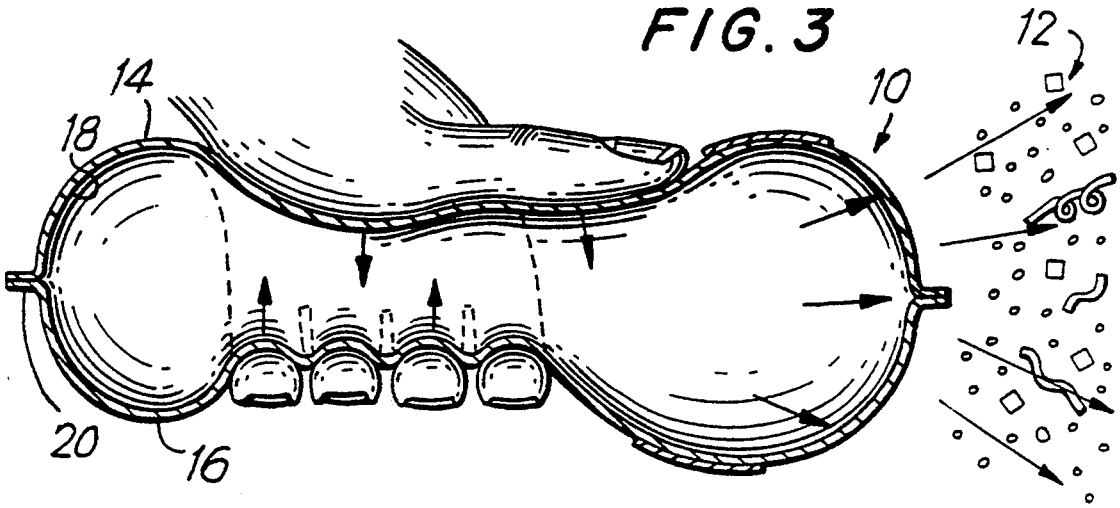
FIG. 3 is a view analogous to FIG. 2 but showing the device in use.

Referring now to FIGS. 1 through 3 of the drawings, reference numeral 10 generally identifies a first embodiment of a device for scattering a multitude of objects 12 in accordance with this invention. Device 10 includes an inflatable envelope having an upper flexible sheet 14 and a lower flexible sheet 16 overlying each other and sealed about their peripheral overlapping edges to bound an interior 18. The flexible sheets 14, 16 may be constituted of paper, plastic, or a plastic-metal laminate, such as aluminum coated over Mylar (trademark). Preferably, the sheets 14, 16 are heat-fused and sealed about their peripheral edges.

A gas inlet 20 extends from the exterior into the interior 18 of the envelope. A non-illustrated nozzle connected to a non-illustrated source of pressurized gas, e.g., air, is inserted into the inlet 20, thereby allowing the introduction of the gas into the envelope to inflate the same. The inlet may be a one-way check valve, as described below in connection with the embodiment of FIGS. 4 through 6, or may simply be an initially unconnected zone at the peripheral edges through which the nozzle is inserted, the zone being subsequently sealed after the nozzle is removed.

As shown in FIG. 1, portions 14*a*, 16*a* of the walls 14, 16 are inverted and pushed back into the interior 18 of the envelope, thereby forming a pocket 22 having an open end 24. The objects 12 are placed within the pocket. The objects 12 include bits of paper and ribbon, both colored and non-colored, both flat and three-dimensional, as well as other items such as rice, candy, toys, and the like and, in short, virtually anything generally regarded as confetti can be used.

A break-away closure 26 is positioned on the envelope in overlapping relationship with the pocket 22 to overlie and close the open end 24 of the pocket. The closure 26 is a low tensile strength tissue paper adhered to the envelope. Preferably, the adhesive is a pressure-sensitive adhesive.

In order to scatter the confetti 12, a user, as illustrated in FIG. 3, squeezes the inflated envelope between one's fingers. The gas within the envelope is forced to the inverted walls 14*a*, 16*a* in a direction tending to reverse their inverted position. That is to say, the pocket 22 is forced out through its end 24. When the pressure within the envelope reaches a predetermined amount, the closure 26 ruptures, and the confetti 12 is suddenly expelled with a concomitant popping sound.

Turning now to the second embodiment of FIGS. 4 through 6, the inflatable envelope is shaped as a champagne bottle 30 containing confetti-like objects 32. Flexible sheets 34, 36 are sealed along their peripheral overlapping edges to bound an interior 38. A gas inlet 40, as previously described, includes a one-way check valve 41. Portions 34*a*, 36*a* of the sheets are inverted and positioned within the bottle 30 to form a pocket 42 having an open end 44. The confetti 32 is contained within the pocket 42.

A break-away closure 46 is positioned over and closes the open end 44. The closure 46 is an adhesive tape, preferably having a score line 48 to provide a weakening zone on the tape.

As before, a user squeezes the inflated envelope between one's fingers, as illustrated in FIG. 6. The pocket is forced out through its end 44. When the pressure within the bottle reaches a predetermined amount, the closure 46 ruptures at the score line 48, and the confetti 32 is suddenly expelled with a concomitant popping sound.

The inflated bottle 30 is self-standing due to its relatively planar base wall 50, and is particularly suitable for such social occasions as celebrating New Year's Eve and weddings.

It will be understood that each of the elements described above, or two or more together, also may find a useful application in other types of constructions differing from the types described above.

While the invention has been illustrated and described as embodied in a device for scattering a multitude of objects and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and described to be protected by Letters Patent is set forth in the appended claims.

1. A device for scattering confetti, comprising:

(a) an inflatable, flexible envelope including a pair of sheets having walls bounding an interior, and a gas inlet for admitting a pressurized gas into the interior, said walls having inverted portions extending into the interior and bounding a pocket having an open end;

(b) a multitude of objects constituting the confetti contained in the pocket; and (c) break-away means including a closure extending across the open end, for frangibly closing the pocket, and for rupturing upon compression of the envelope with a predetermined force sufficient to cause the gas to reverse the inverted portions, tear the closure, and expel the confetti in an explosive manner with an accompanying popping sound.

2. A device according to claim 1, wherein the sheets are sealed together about their peripheries.

3. A device according to claim 2, wherein the sheets are constituted of a synthetic plastic material, and are heat-sealed together along their peripheries.

4. A device according to claim 1, wherein the gas inlet includes a one-way check valve extending through the envelope.

5. A device according to claim 1, wherein the objects include bits of colored paper and ribbon.

6. A device according to claim 1, wherein the closure is a low tensile strength paper adhered over the open end of the pocket.

7. A device according to claim 1, wherein the closure is an adhesive closure having a score line.

8. A device according to claim 1, wherein the envelope walls have a bottle-shaped configuration.

9. A method of making a device for scattering objects, comprising the steps of:

(a) forming an inverted pocket having an open end from an inflatable, flexible envelope;

(b) filling the pocket with a multitude of objects;

(c) frangibly closing the pocket by placing a break-away closure across the open end of the pocket; and (d) inflating the envelope with a pressurized gas, and sealing the envelope with the pocket extending into an interior of the envelope.

10. The method according to claim 9, wherein the inflating step is performed prior to the forming step.

11. The method according to claim 9, wherein the inflating step is performed after the closing step.

* * * * *